US011141750B2

(12) United States Patent
Alluigi

(10) Patent No.: US 11,141,750 B2
(45) Date of Patent: Oct. 12, 2021

(54) COMPACT DISPENSING DEVICE

(71) Applicant: GUALA DISPENSING S.P.A., Alessandria (IT)

(72) Inventor: Riccardo Alluigi, Alessandria (IT)

(73) Assignee: GUALA DISPENSING S.P.A., Alessandria (IT)

( * ) Notice: Subject to any disclaimer, the term of this patent is extended or adjusted under 35 U.S.C. 154(b) by 0 days.

(21) Appl. No.: 16/652,900

(22) PCT Filed: Sep. 7, 2018

(86) PCT No.: PCT/IB2018/056834

§ 371 (c)(1),
(2) Date: Apr. 1, 2020

(87) PCT Pub. No.: WO2019/069153

PCT Pub. Date: Apr. 11, 2019

(65) Prior Publication Data

US 2020/0316630 A1 Oct. 8, 2020

(30) Foreign Application Priority Data

Oct. 6, 2017 (IT) ..... 102017000112568

(51) Int. Cl.
*B05B 11/00* (2006.01)
*B05B 1/34* (2006.01)

(52) U.S. Cl.
CPC ..... *B05B 11/3011* (2013.01); *B05B 11/3057* (2013.01); *B05B 1/3436* (2013.01);
(Continued)

(58) Field of Classification Search
CPC ..... B05B 1/3436; B05B 11/0027; B05B 11/0044; B05B 11/3011; B05B 11/3014;
(Continued)

(56) References Cited

U.S. PATENT DOCUMENTS 4,277,001 A * 7/1981 Nozawa ..... B05B 11/0059 222/321.4
4,345,718 A 8/1982 Horvath
(Continued)

FOREIGN PATENT DOCUMENTS

JP H0938540 A 2/1997
JP 2008296115 A 12/2008
(Continued)

OTHER PUBLICATIONS

International Search Report for International Patent Application No. PCT/IB2018/056834, dated Nov. 29, 2018, 4 pages.

*Primary Examiner* — Vishal Pancholi
*Assistant Examiner* — Bob Zadeh
(74) *Attorney, Agent, or Firm* — Armstrong Teasdale LLP

(57) ABSTRACT

A dispensing device including a bottle provided with a neck and a trigger dispensing head fitted to the neck is provided. The dispensing head includes a socket at least partially housed in the neck compartment, a main body that, with the socket, delimits a valve compartment in the neck, a valve group, a piston, a chassis, a trigger group, and elastic return elements. The valve group is contained in the valve compartment, limiting the overall size of the device.

18 Claims, 8 Drawing Sheets

(52) U.S. Cl.
CPC ..... *B05B 11/0044* (2018.08); *B05B 11/3059* (2013.01); *B05B 11/3074* (2013.01)

(58) Field of Classification Search
CPC ..... B05B 11/3021; B05B 11/3057; B05B 11/3059; B05B 11/3074
See application file for complete search history.

(56) References Cited

U.S. PATENT DOCUMENTS

| | | | | |
|---|---|---|---|---|
| 5,297,701 | A * | 3/1994 | Steijns | B05B 11/0029 222/153.05 |
| 2002/0008164 | A1* | 1/2002 | Yanagida | B05B 12/002 239/525 |
| 2005/0082311 | A1* | 4/2005 | Good | B05B 11/3057 222/1 |
| 2007/0131718 | A1* | 6/2007 | Bistolfi | B05B 11/0044 222/189.09 |
| 2008/0116222 | A1* | 5/2008 | Alluigi | B05B 11/0032 222/153.13 |
| 2012/0018456 | A1* | 1/2012 | Alluigi | B05B 11/3057 222/321.8 |
| 2017/0080443 | A1* | 3/2017 | Alluigi | B05B 11/303 |

FOREIGN PATENT DOCUMENTS

| | | | |
|---|---|---|---|
| WO | 2007040133 | A1 | 4/2007 |
| WO | 2009044626 | A1 | 4/2009 |
| WO | 2014013352 | A1 | 1/2014 |

* cited by examiner

COMPACT DISPENSING DEVICE

CROSS-REFERENCE TO RELATED APPLICATIONS

This application is a National Phase filing of PCT International Application No. PCT/IB2018/056834, having an International Filing Date of Sep. 7, 2018, which claims the benefit of priority to Italian Patent Application No. 102017000112568, having a filing date of Oct. 6, 2017, each of which is hereby incorporated by reference in its entirety.

FIELD OF THE INVENTION

The object of the present invention is a trigger dispensing device, suitable for dispensing liquid or semi-dense products, in particular intended for the body care product sector, such as beauty products, deodorants, hair care products, sun protection products for the skin and similar products.

BACKGROUND OF THE INVENTION

Such products are generally used in small quantities and are offered for sale in small bottles, also to limit the overall cost of purchase.

Consequently, the dispensing head fitted on the bottle should be particularly compact, so as to create an aesthetically pleasing combination with the bottle.

SUMMARY OF THE INVENTION

The object of the present invention is to meet needs of the body care sector. Such object is achieved by a dispensing device having the features described below. Advantageous embodiments of the present invention are also described.

The features and advantages of the dispensing device according to the present invention will be apparent from the description given below, provided by way of non-limiting example, with reference to the accompanying drawings.

DETAILED DESCRIPTION

Figure 1A:
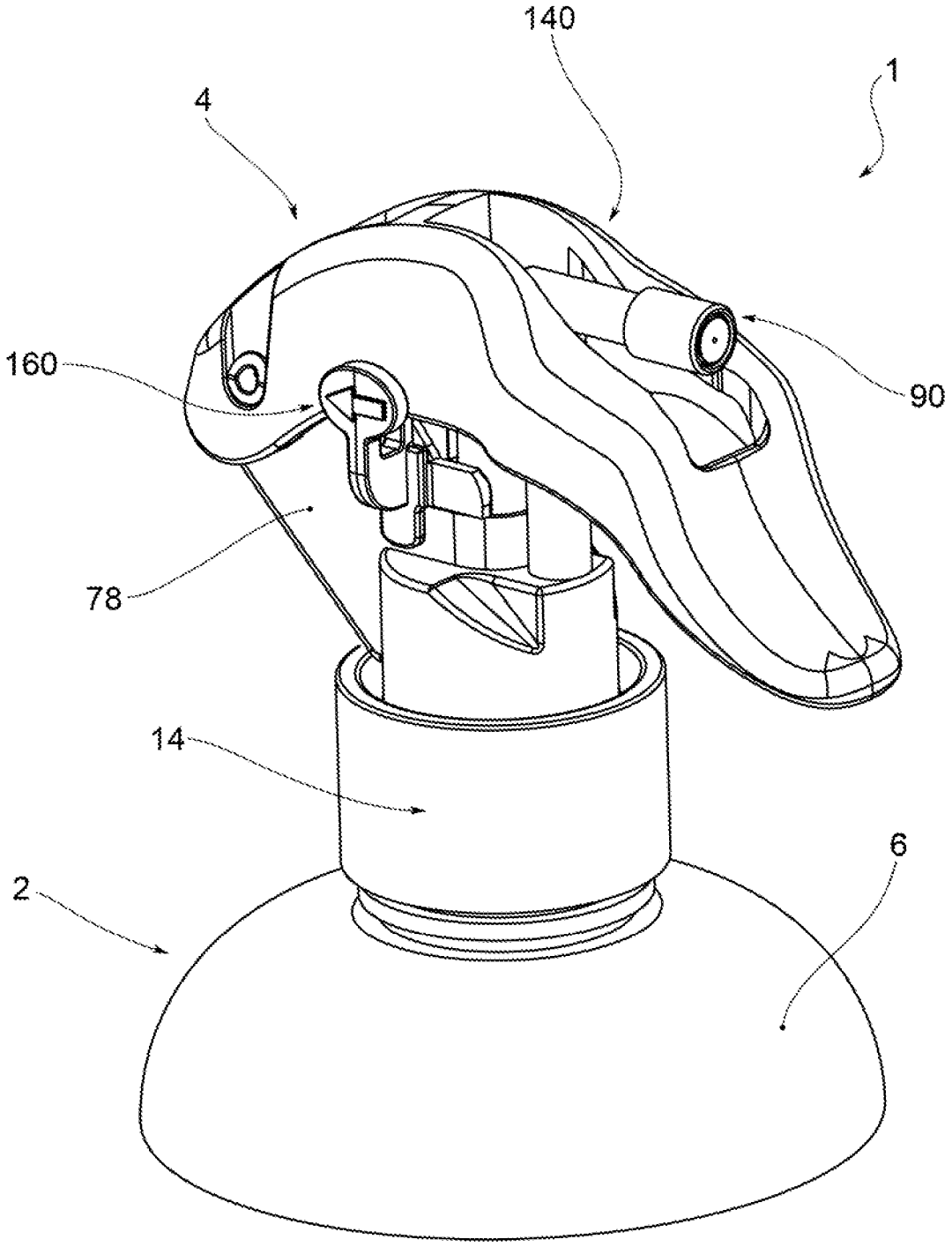
FIGS. 1*a* and 1*b* illustrate a dispensing device according to an embodiment of the present invention, in a resting configuration.
Figure 1B:
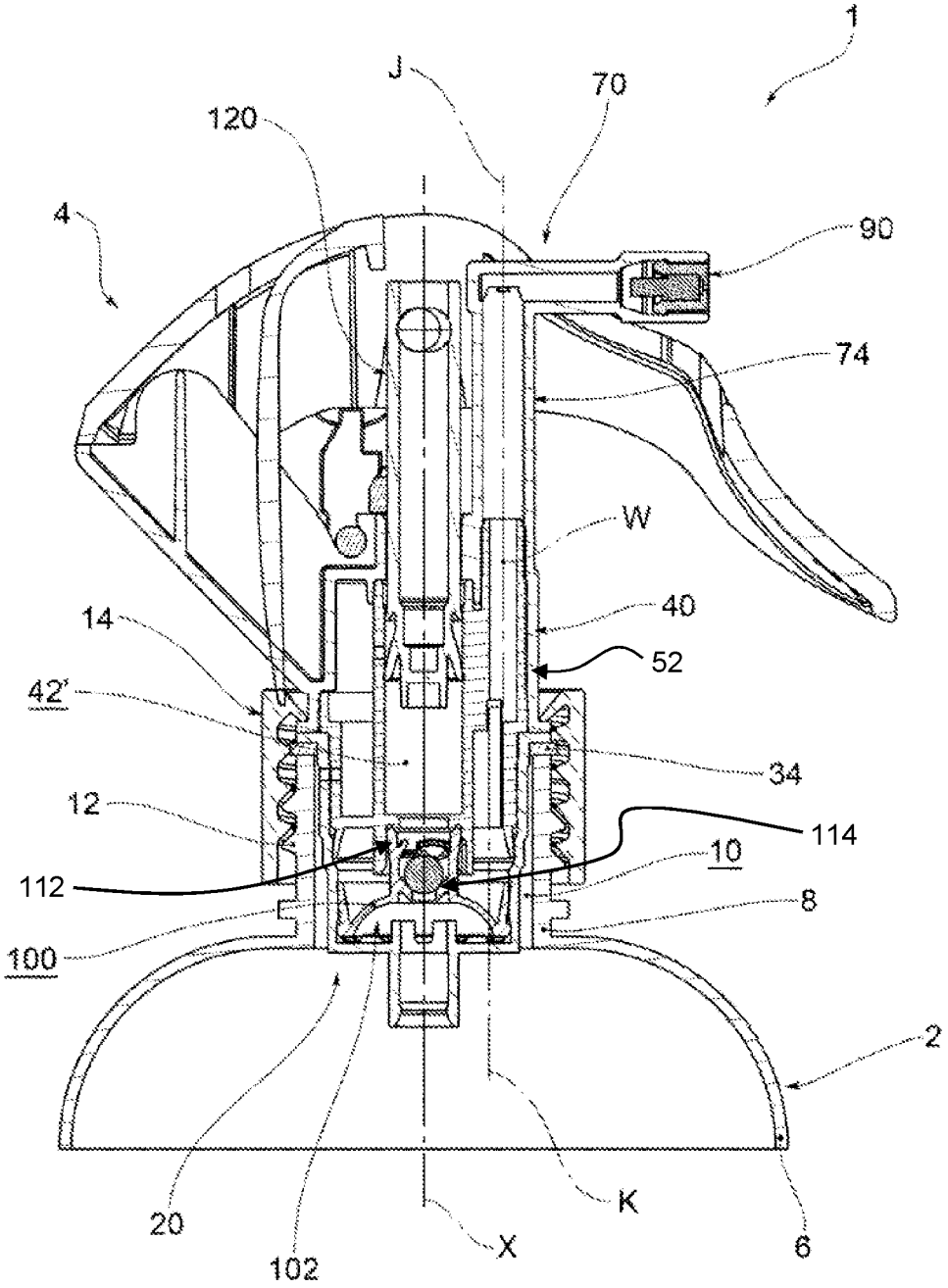
Figure 2A:
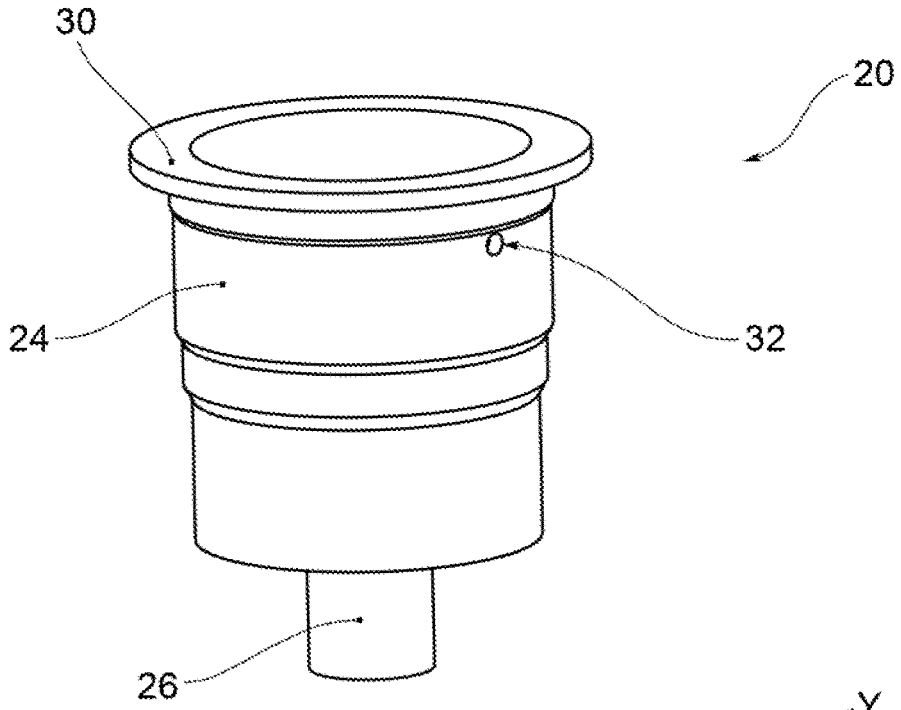
FIGS. 2*a* and 2*b* show a socket of the dispensing device of FIGS. 1*a* and 1*b;*
Figure 2B:
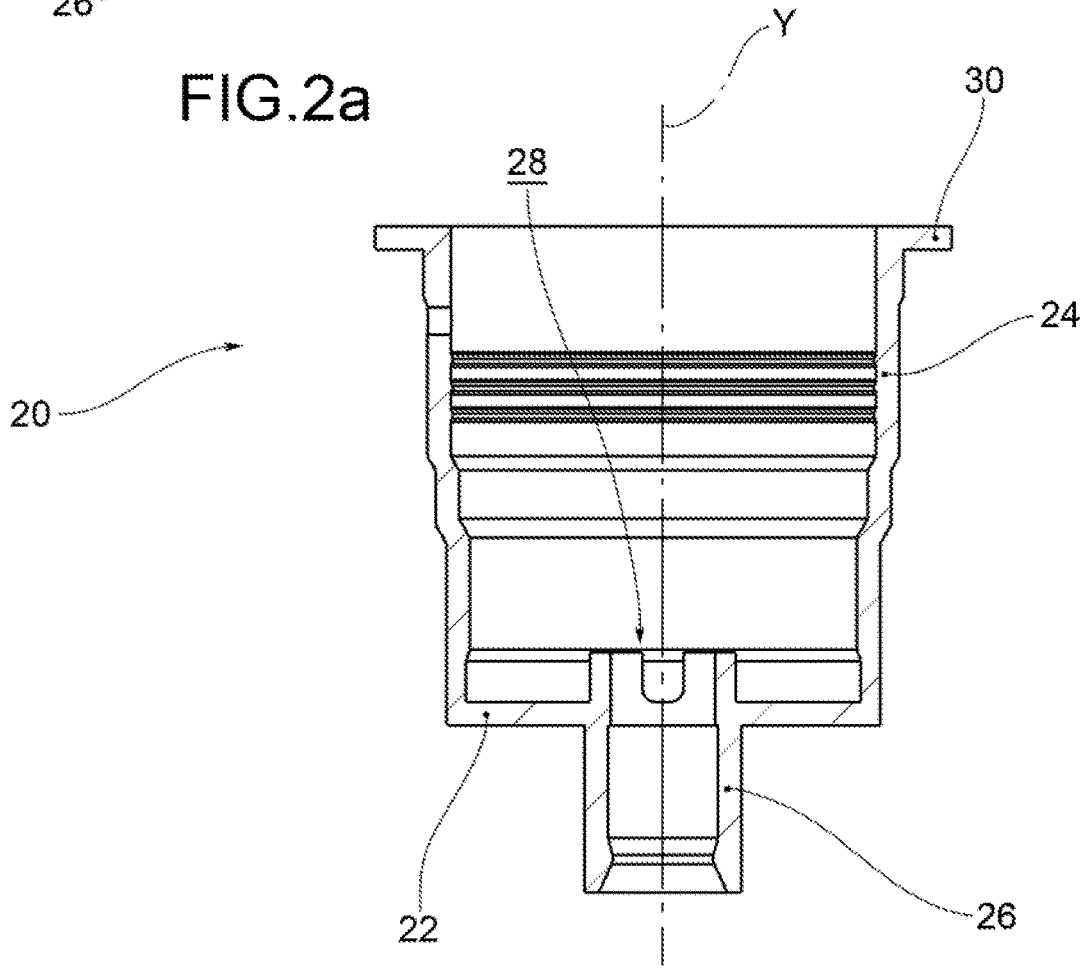
Figure 3A:
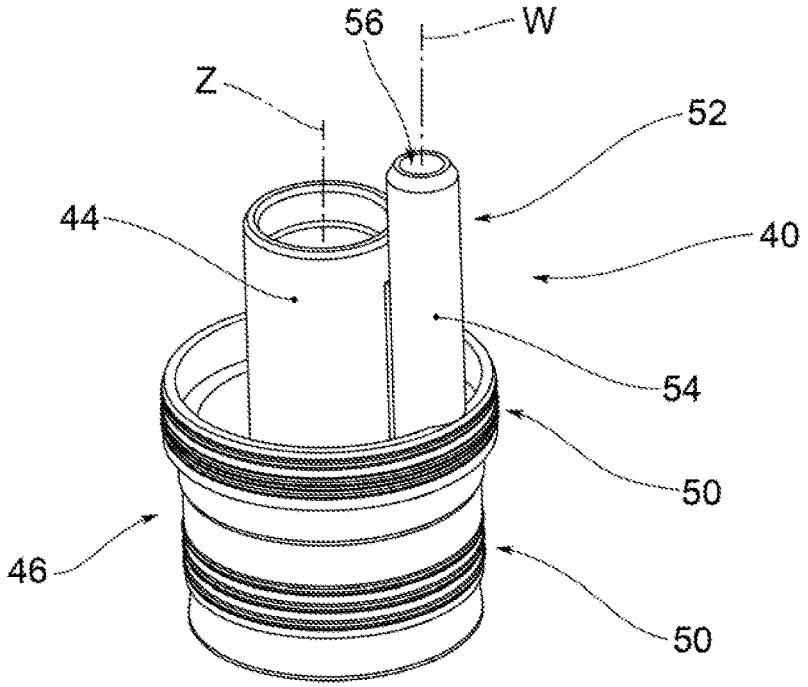
FIGS. 3*a* and 3*b* show a main body of the dispensing device of FIGS. 1*a* and 1*b;*
Figure 3B:
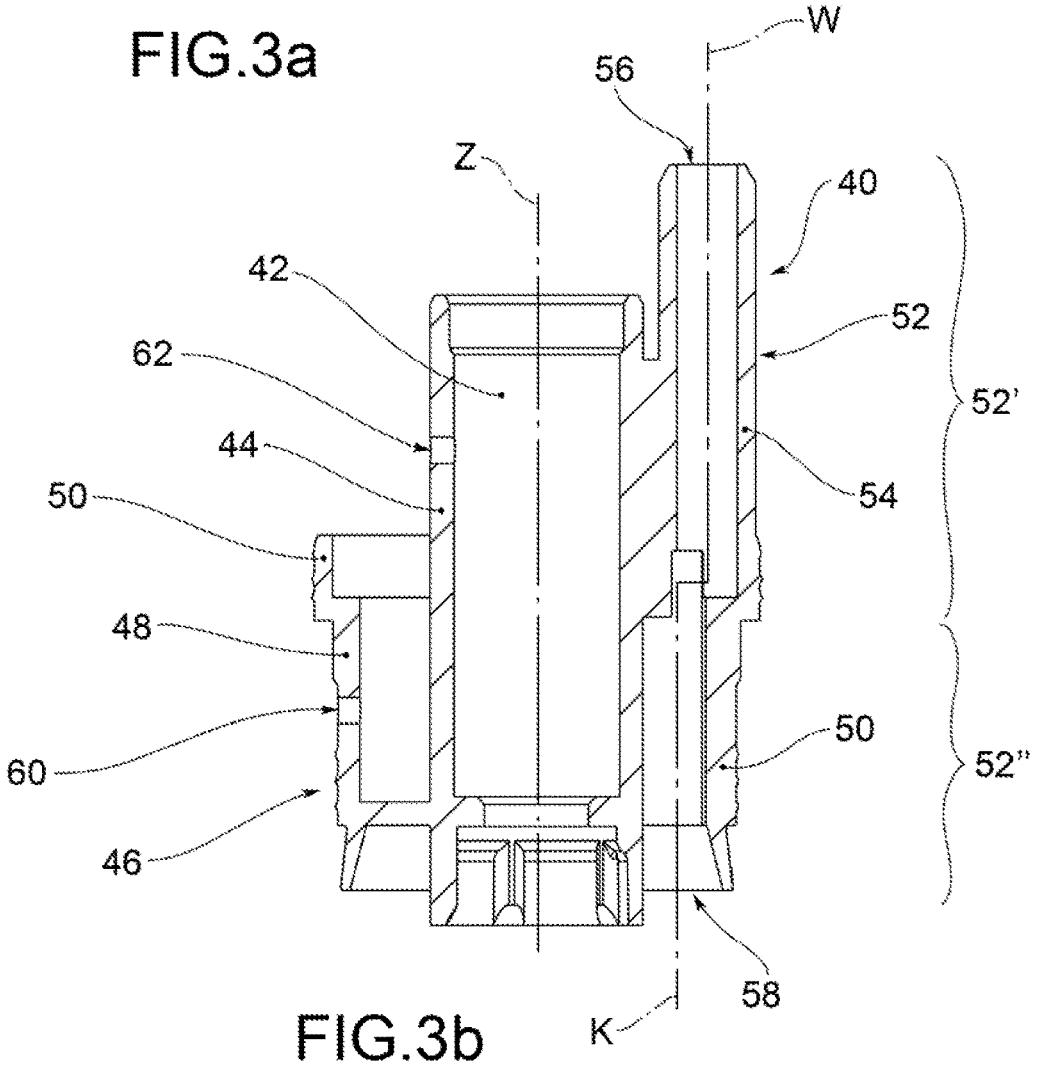
Figure 4B:
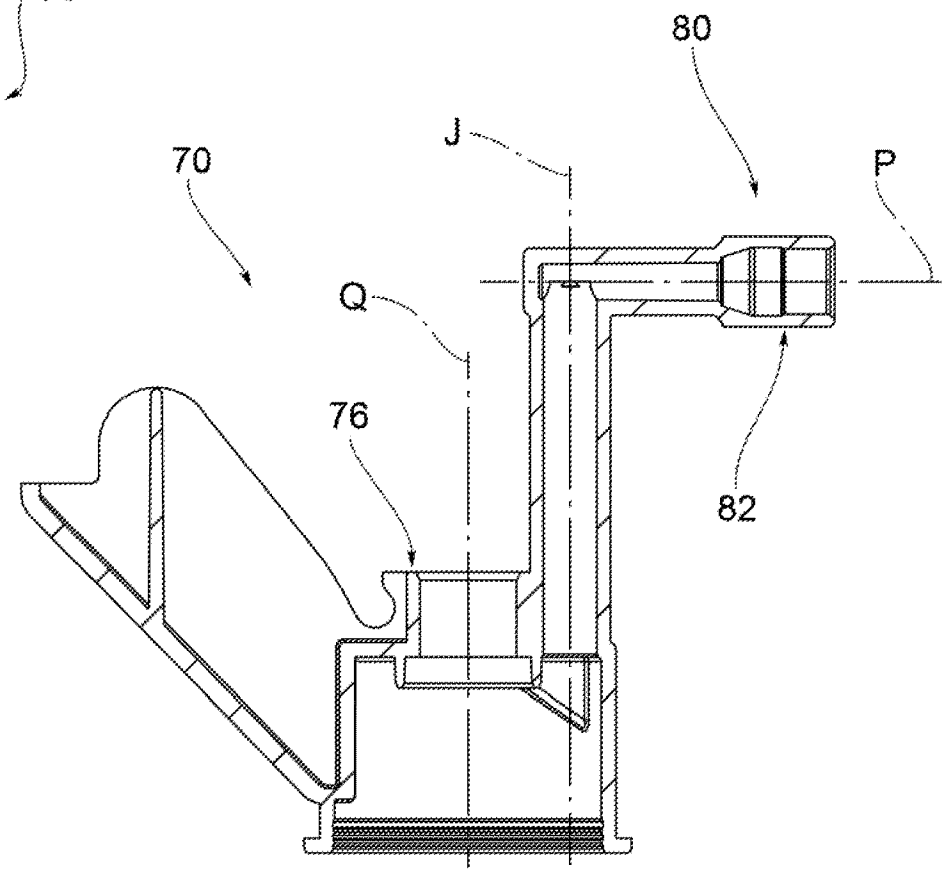
FIGS. 4*a* and 4*b* show a chassis of the dispensing device of FIGS. 1*a* and 1*b;*
Figure 4A:
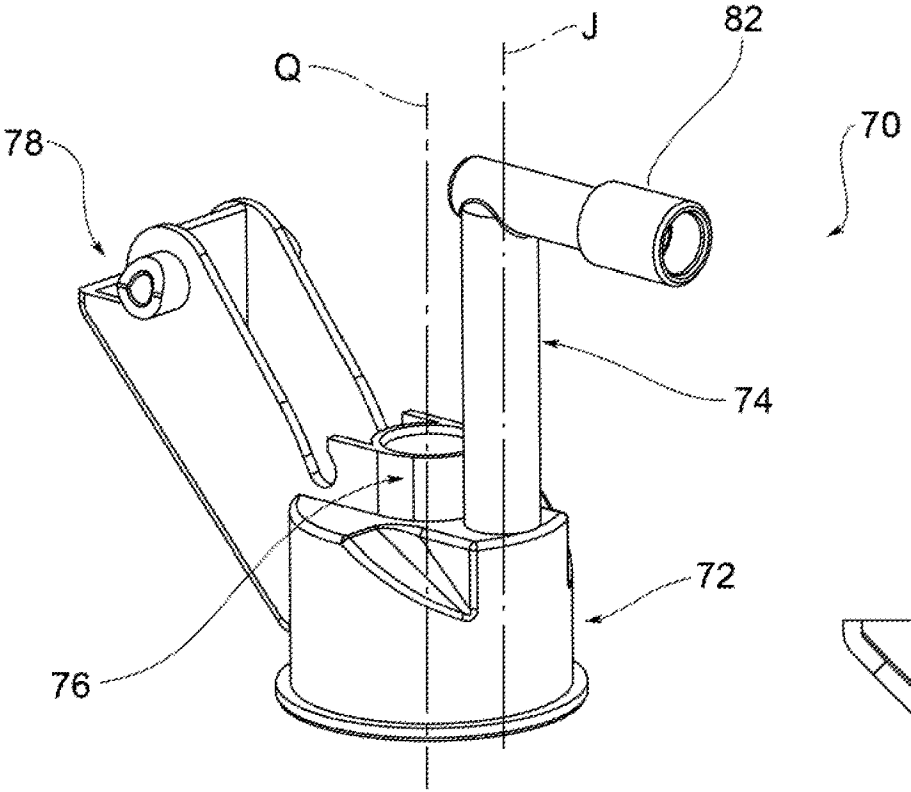
Figure 5A:
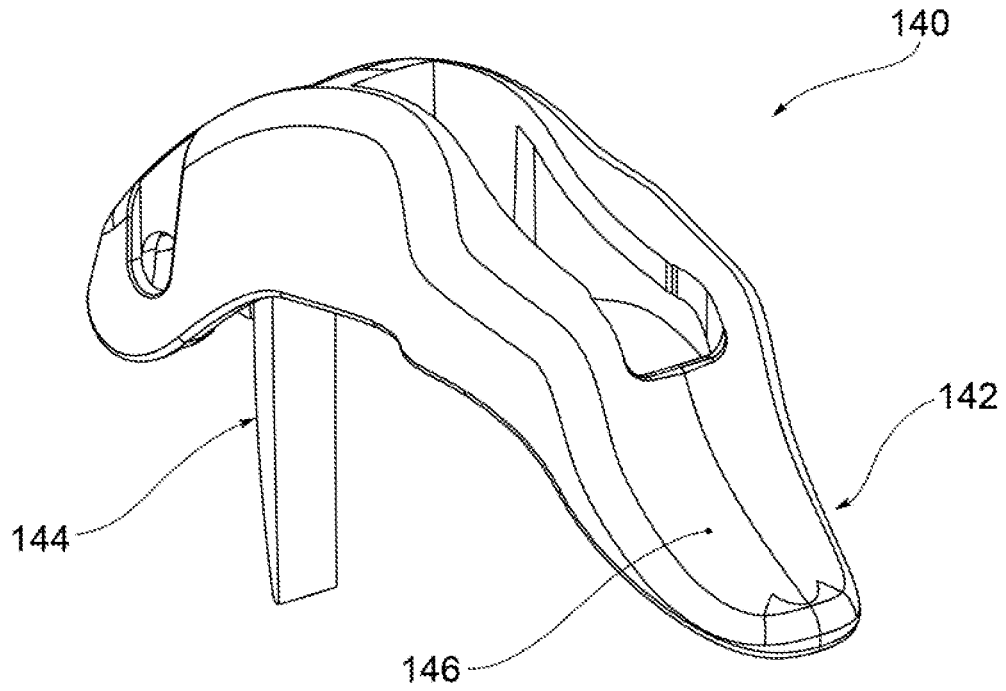
FIGS. 5*a* and 5*b* show a trigger group of the dispensing device of FIGS. 1*a* and 1*b;*
Figure 5B:
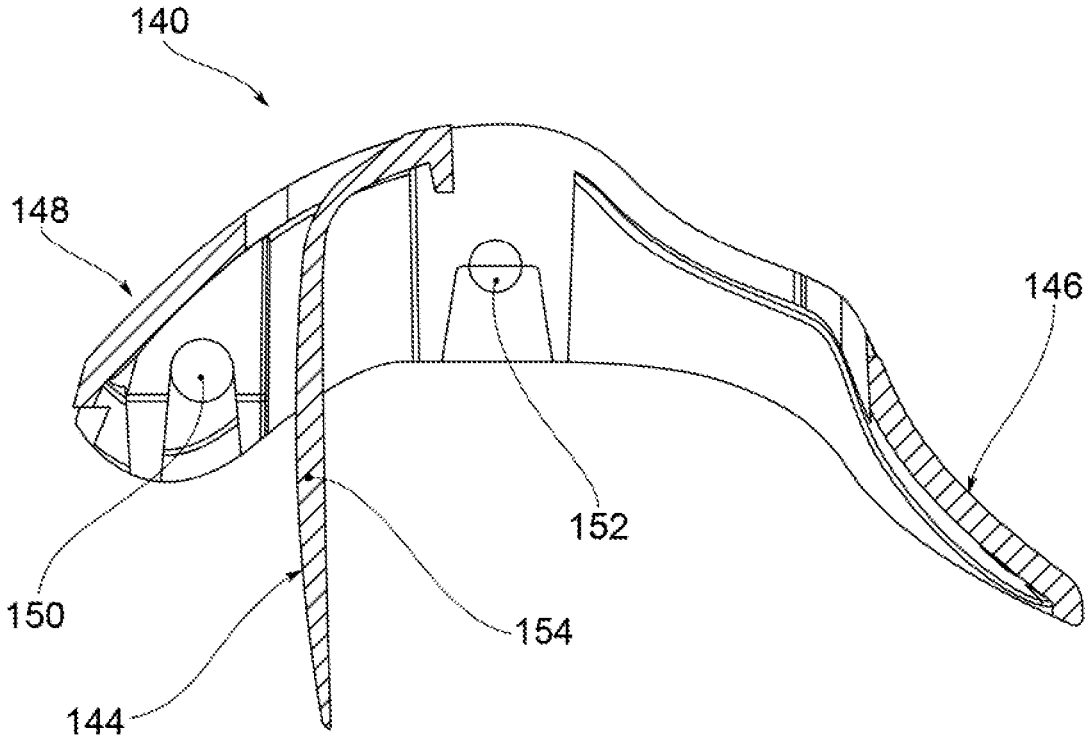
Figure 6A:
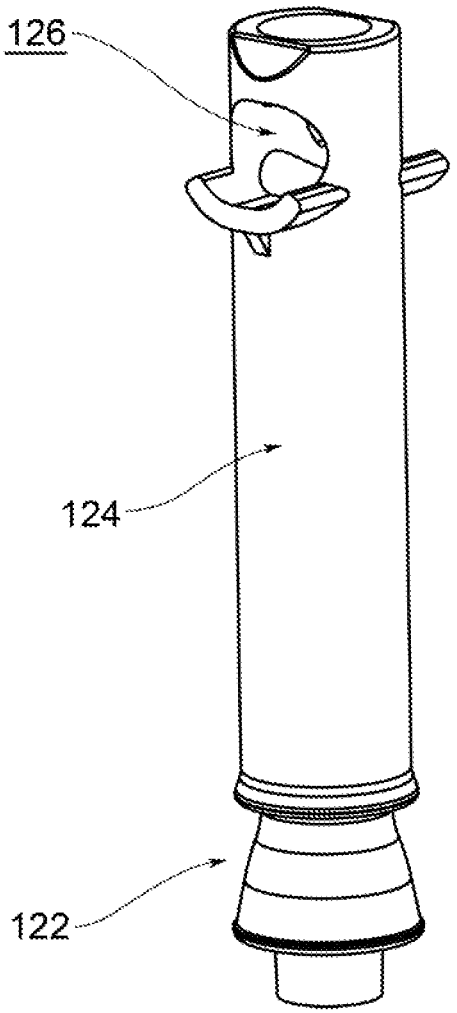
FIGS. 6*a* and 6*b* show a piston of the dispensing device of FIGS. 1*a* and 1*b; and*
Figure 6B:
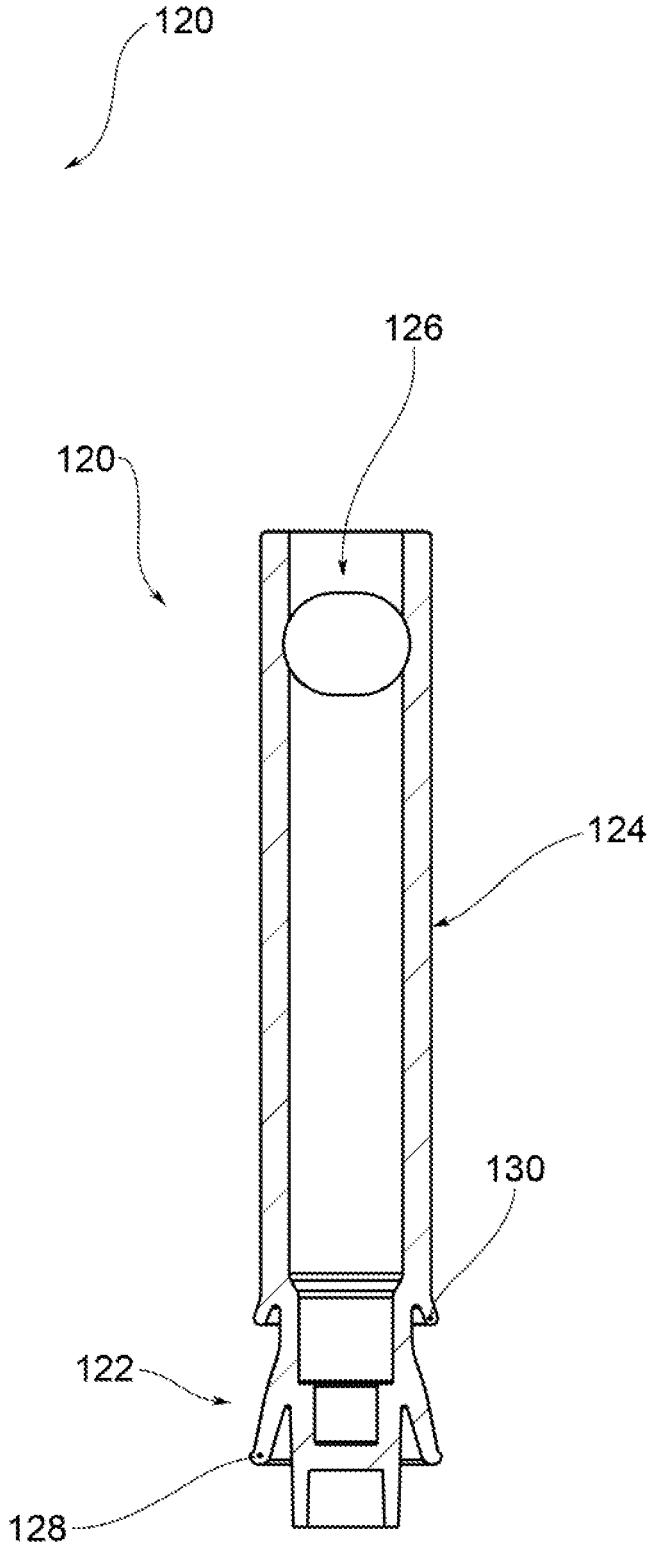
Figure 7B:
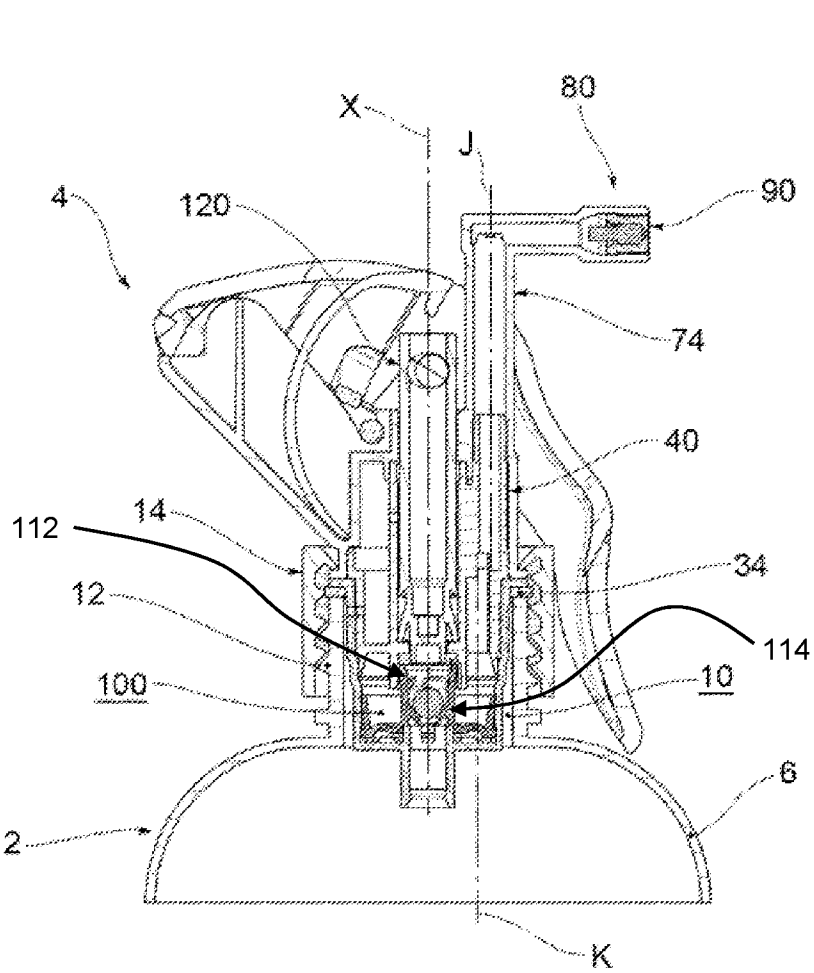
FIGS. 7*a* and 7*b* show the dispensing device in a limit dispensing configuration.
Figure 7A:
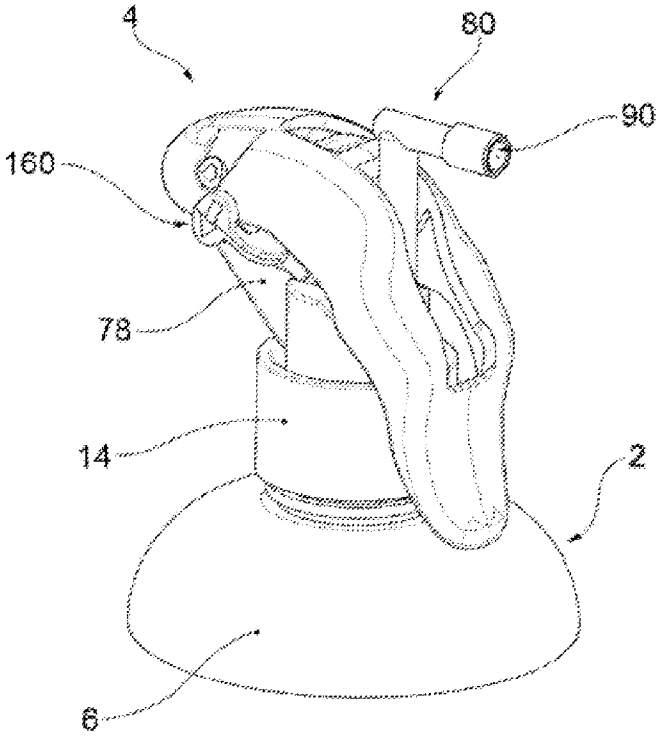

With reference to the accompanying figures, a dispensing device consisting of a bottle 2 and a dispensing head 4, fitted to the bottle 2, is indicated collectively at 1.

The bottle 2 comprises a bottle wall 6 and a neck 8, having a central neck axis X, which annularly delimits an inner neck compartment 10. The dispensing head 4 engages with the neck 8 of the bottle 2.

For example, the neck 8 has an outer thread 12 for screwing on a cap 14 that allows the head 4 to be fastened to the bottle 2.

The head 4 comprises a socket 20, for example, made in one piece of plastic material, provided with a central socket axis Y and comprising a socket bottom 22 and an annular socket wall 24, protruding axially from the socket bottom 22.

The socket bottom 22 has, for example, centrally, a tubular socket shank 26 that leads into the socket through a shank opening 28, preferably raised with respect to the inner surface of the socket bottom 22. Said socket shank 26 is configured to be used with a small suction tube for the product contained in the bottle.

Preferably, the socket wall 24 comprises, at the end opposite the socket bottom 22, an annular socket cuff 30, continuous or in sectors, protruding radially externally, with the function of providing support to the rim of the neck 8.

Preferably, through the socket wall 24 a socket through-hole 32 is obtained, which is part of the vent elements described hereinafter.

The socket 20, and in particular the socket wall 24, is suitable to be housed in the neck compartment 10 of the neck 8.

Once the socket 20 is inserted into the neck 8 of the bottle 2, so that the socket axis Y coincides with the neck axis X, the socket shank 26 protrudes below the neck 8, the socket wall 24 is housed in the neck compartment 10 and the socket cuff 30 rests on the rim of the neck 8, for example, by means of an annular seal 34.

In addition, the dispensing head 4 further comprises a multifunctional main body 40, made in a single piece of plastic material.

The main body 40 comprises a cylinder 42 which extends along a main axis Z, delimited annularly by a tubular cylinder wall 44.

Additionally, the main body 40 comprises a skirt 46 comprising an annular skirt wall 48 coaxial to the main axis Z, surrounding the cylinder wall 44, while remaining radially spaced therefrom.

Preferably, the skirt 46 comprises a plurality of circumferential ridges 50, placed on the outer surface of skirt wall 48, suitable to interlock with the socket 20.

Moreover, the main body 40 comprises a dispensing tube 52 extending at least for an upper section 52' along a secondary axis W, parallel and offset with respect to the main axis Z.

Preferably, the dispensing tube 52 comprises a second section 52" extending along a third axis K, parallel and offset with respect to the main axis Z and the secondary axis W, and proximal to the main axis Z with respect to the secondary axis W.

Preferably, the dispensing tube 52 is delimited partly by the cylinder wall 44 of the cylinder 42, partly by the skirt wall 48 of the skirt 46 and partly by a tube wall 54.

In particular, the first section 52' is delimited by the tube wall 54, partly joined to the cylinder wall 44; the second section 52", on the other hand, is delimited partly by the skirt wall 48, partly by the cylinder wall 44 and partly by the tube wall 54.

The dispensing tube 52 is open at the top, at the first section 52', through an upper opening 56, and at the bottom, at the second section 52", through a lower opening 58, within the skirt 46.

Preferably, a skirt through-hole 60 is made through the skirt wall 48 and a cylinder through-hole 62 is made through the cylinder wall 44, both the skirt through-hole and the cylinder through-hole being part of the vent elements described hereinafter.

The main body 40 is inserted, at least partially, within the socket 20, so that the main axis Z coincides with the socket axis Y.

Preferably, the circumferential ridges 50, present on the outside of the skirt wall 48, interlock with the inner surface of the socket wall 24, preferably with similar circumferential ridges present on said inner surface.

When the main body 40 is engaged with the socket 20, part of the cylinder 42 is placed within the socket 20 (and thus inside the neck compartment 10), while the dispensing tube 52 protrudes axially above the socket 20 and above the neck 8.

In addition, when the main body 40 is engaged with the socket 20, said main body 40 rests on the socket 20, and in particular the skirt 46 rests on the socket cuff 30.

Preferably, the dispensing head 4 also comprises a chassis 70, for example made in a single piece of plastic material, comprising a casing 72 and an extension tube 74, extending along an extension axis J.

The casing 72 also has a casing passage 76 having a passage axis Q, parallel to and spaced from the extension axis J of the extension tube 74.

Moreover, the chassis 70 comprises a shank 78, protruding from the casing 72, opposite the tube extension 74 with respect to the passage axis Q, for example, deviating therefrom. The shank 78 is configured for engagement with a trigger group, which will be described hereinafter.

Moreover, the chassis 70 comprises an end tube 80 extending along an end axis P, inclined, for example, orthogonal, to the extension axis J. The end tube 80 ends preferably with an enlargement 82 for the insertion of a dispensing nozzle 90.

The chassis 70 is configured to be inserted into the main body 40 so that the passage axis Q coincides with the main axis Z.

When the chassis 70 is in place, the casing 72 covers the part of the dispensing tube 52 and the cylinder 42 that exit from the socket 20.

Moreover, the dispensing tube 52 of the main body 40 engages with the extension tube 74 of the chassis 70, so that the extension axis J coincides with the secondary axis W of the main body 40.

The inner duct of the dispensing tube 52, the inner duct of the extension tube 74 and the inner duct of the end tube 80 are in fluid communication, in sequence with each other, forming a dispensing path of the product.

Moreover, the casing 72 of the chassis 70 rests on the rim of the neck 8, and in particular on the socket cuff 30 of the socket 20. Applying the cap 14, thus allows the socket 20 and chassis 70 to be fastened to the neck 8 of the bottle 2.

The dispensing head 4 further comprises a piston 120, equipped with a sealably sliding piston head 122 in the cylinder 42, between an upper or resting limit position, wherein it defines in the cylinder 42 a dosing chamber 42', and a lower or dispensing limit position, wherein the dosing chamber 42' has minimum volume.

The piston 120 further comprises a piston body 124, ending with the piston head 122, having an extension that, even in the dispensing limit position, it exits from the chassis 70, passing through the casing passage 76.

At the free end of the piston body 124, on the opposite side of the piston head 122, said piston body 124 has an engagement hole 126, for example slotted, transverse to the axis of the piston.

Once the main body 40 has been fitted to the socket 20, between the main body 40 and the bottom 22 of the socket 20, a valve compartment 100 remains, where a valve group 110 of the dispensing head 4 is housed.

Said valve group 110 comprises a normally closed pre-compression valve 112, operating between the dosing chamber 42' and the duct inside the dispensing tube 52 to allow passage of the product to be dispensed when the pressure in the dosing chamber exceeds a predefined threshold pressure.

Said valve group 110 further comprises a normally closed non-return valve 114, which operates between the dosing chamber 42' and the inside of the bottle to prevent a flow of product from the dosing chamber 42' to the inside of the bottle and to allow a flow of product from the inside of the bottle to the dosing chamber 42'.

Preferably, the pre-compression valve 112 and the non-return valve 114 are integrated with each other according to the teaching provided in Applicant's International Application WO2014/013352, which is expressly incorporated herein.

The dispensing head 4 also comprises a trigger group 140, in a single piece of plastic material, comprising a trigger 142 and a spring portion 144.

The spring portion 144 is an example embodiment of elastic return elements engaged with the trigger or with the piston, operating permanently to bring the dispensing device to the initial resting configuration.

The trigger 142 extends from a front portion 146, shaped to be suitable to a user to rest fingers (usually the index finger and the middle finger) to activate the dispensing device, to a rear portion 148, intended for hinging to the shank 78 of the chassis 70, e.g. through a hole 150.

Between the front portion 146 and the rear portion 148, an engagement element 152 for engagement with the piston 120 is provided. For example, said engagement element 152 is a pin suitable to be inserted into the engagement hole 126 of the piston 120.

The spring portion 144 comprises a blade 154, preferably housed inside the shank 78 of the chassis, suitable to deform elastically when the trigger 142 is pressed and to return the trigger 142 to its initial position when said trigger 142 is released.

Finally, according to a preferred embodiment, the dispensing head comprises a locking device 160, either removable or non-removable from the head, suitable to lock, when activated, the movement of the trigger or of the piston.

For example, said locking device 160 is irremovable from the head and, in a locked configuration, it locks the trigger movement. Said locking device 160 is translatable in an unlocked configuration, wherein it does not interfere with the movement of the trigger.

During normal use of the dispensing device according to the present invention, the dispensing device is in an initial resting configuration, wherein the trigger 142 is in a resting position corresponding to the piston 120 in the resting limit position; the pre-compression valve 112 is closed, and the non-return valve 114 is closed. It is assumed that the dosing chamber 42' is already full of the product to be dispensed.

The manual trigger operation 142, using the fingers to push the front portion 146 of said trigger 142, causes a thrust action on the piston 120, so that the pressure in the dosing chamber 42' increases.

Once the predetermined threshold pressure in the dosing chamber 42' has been exceeded, the pre-compression valve 112 opens and allows the product to flow from the dosing chamber 42' to the inner duct of the dispensing tube 52, by passing through the valve compartment 100 (dispensing stage).

The product runs through the inner duct of the dispensing tube 52, the inner duct of the extension tube 74, the inner duct of the end tube 80, the dispensing nozzle 90 and flows out into the environment.

Meanwhile, the piston 120 comes to the dispensing limit position and the trigger is released.

At times the trigger is released before the piston has reached the dispensing limit position; this does not change the operation of the device.

Once the trigger is released, due to the action of the spring portion 144, the trigger is pushed to the initial resting position, and so is the piston 120.

Consequently, a vacuum is made in the dosing chamber 42', which leads to closure of the pre-compression valve 112 at the opening of the non-return valve 114 and the suction of product from inside the bottle into the dosing chamber 42' (suction stage).

To balance the removal of product from the inside of the bottle, the dispensing head 4 comprises vent elements suitable to put the inside of the bottle in communication with the external environment, while preventing escape of liquid.

According to a preferred embodiment, said vent elements comprise the socket hole 32, preferably the skirt hole 60, the cylinder hole 62 and preferably the piston head 122. The socket hole 32, the skirt hole 60 and the cylinder hole 62 are in fluid communication with each other; moreover, the socket hole 32 is in fluid communication with the inside of the bottle, and the cylinder hole 62 may be placed in fluid communication with the external environment by virtue of the gap between the piston body 124 and the inner surface of the cylinder 44.

In particular, in one embodiment, the piston head 122 provides for a main lip 128, which forms a first seal with the inner surface of the cylinder 44, and a secondary lip 130, placed behind the main lip 128, which forms a second seal with the inner surface of the cylinder 44.

In the resting limit position of the piston 120, the cylinder hole 62 is placed between the main lip 128 and the secondary lip 130, whereby it is not in communication with the external environment. Said vent elements are normally closed (preventing accidental escape of product from inside the bottle to the external environment).

When piston 120 moves to the dispensing limit position, the secondary lip 130 passes over the position of the cylinder hole 62, placing it in communication with the external environment. Said vent elements are thus open and allow air to enter the inside of the bottle, balancing the product outflow during the suction stage.

Innovatively, the dispensing device according to the present invention meets the requirements mentioned above, as the dispensing head is particularly compact.

In effect, the head protrudes only partially above the neck of the bottle, since the valve is housed in the neck compartment.

Advantageously, the dispensing head is very economical, as it consists of a limited number of components, all made of plastic and each having several functions.

According to a further advantageous aspect, the dispensing device allows to spray precisely the desired area, as the nozzle remains fixed during the dispensing stage.

According to a variant embodiment of the invention, the spring portion is not integrated with the trigger and constitutes a separate component, operating on the trigger or directly on the piston.

It is clear that one skilled in the art, in order to meet contingent needs, may make changes to the dispensing device described above, without departing from the scope of protection described and claimed herein.

The invention claimed is:

1. A dispensing device comprising:

a bottle provided with a neck having a neck axis (X), wherein the neck delimits internally a neck compartment;

a trigger dispensing head applied to the neck of the bottle in a separable manner, the trigger dispensing head comprising:

a) a socket at least partially housed in the neck compartment;

b) a main body comprising a cylinder extending along a main axis (Z) coinciding with the neck axis (X) and a dispensing tube having at least a first section extending along a secondary axis (W) parallel to and spaced from the main axis (Z), wherein the main body is at least partially inserted in the socket, thereby delimiting, in a portion contained in the neck compartment of the socket, a valve compartment;

c) a valve group comprising a pre-compression valve, which allows the passage of the product to be dispensed when the pressure in a dosing chamber exceeds a predefined threshold pressure, and a non-return valve, the valve group housed in the valve compartment of the socket;

d) a sealably sliding piston in the cylinder;

e) a trigger group engaged with the piston, comprising a trigger for actuating the dispensing device; and f) elastic return elements engaged with the trigger or with the piston, operating permanently to bring the dispensing device to an initial resting configuration.

2. The dispensing device of claim 1, wherein the trigger dispensing head further comprises:

g) a chassis engaged with the main body, the chassis comprising an extension tube extending along an extension axis (J) coinciding with the secondary axis (W) and an end tube extending along an inclined end axis (P), orthogonal with respect to the extension axis (J).

3. The dispensing device of claim 2, wherein the trigger group is hinged to the chassis.

4. The dispensing device of claim 2, wherein the piston comprises a piston head provided with at least one sealing lip and a piston body having an extension to protrude from the chassis even at a lower limit or dispensing position, to engage with the trigger group.

5. The dispensing device of claim 1, wherein the dispensing tube comprises a second section extending along a third axis (K) parallel to and offset from the main axis (Z) and the secondary axis (W), and proximal to the main axis (Z) with respect to the secondary axis (W).

6. The dispensing device of claim 1, wherein the elastic return elements comprise a spring portion composed of a blade made in one piece with the trigger.

7. The dispensing device of claim 1, further comprising vent elements suitable to put the inside of the bottle in communication with an outside environment, while avoiding escape of liquid.

8. The dispensing device of claim 7, wherein the vent elements comprise a socket hole passing through a socket wall in the neck compartment and a cylinder hole passing through a main wall of the cylinder, wherein the socket hole and the cylinder hole are in fluid communication with each other.

9. The dispensing device of claim 1, further comprising a locking device suitable to lock, when activated, movement of the trigger or of the piston.

10. The dispensing device of claim 1, wherein a socket axis (Y) of the socket coincides with the neck axis (X).

11. The dispensing device of claim 1, wherein the socket includes a socket bottom and an annular socket wall that protrudes axially from the socket bottom.

12. The dispensing device of claim 11, wherein the socket bottom includes a socket shank, and wherein the socket wall includes an annular socket cuff opposite the socket bottom.

13. The dispensing device of claim 12, wherein the socket shank protrudes below the neck, the socket wall is housed in the neck compartment, and the socket cuff rests on a rim of the neck.

14. The dispensing device of claim 1, wherein the main body further comprises a skirt, the skirt including a skirt wall coaxial to the main axis (Z), the skirt wall radially spaced from and surrounding a cylinder wall of the cylinder.

15. The dispensing device of claim 14, wherein the skirt includes a plurality of circumferential ridges on an outer surface of the skirt wall, the circumferential ridges configured to interlock with the socket.

16. The dispensing device of claim 14, wherein the dispensing tube is delimited by the cylinder wall, the skirt wall, and a tube wall.

17. The dispensing device of claim 16, wherein the first section of the dispensing tube is delimited by the tube wall, which is partially joined to the cylinder wall.

18. The dispensing device of claim 17, wherein the dispensing tube comprises a second section extending along a third axis (K) parallel to and offset from the main axis (Z) and the secondary axis (W), and proximal to the main axis (Z) with respect to the secondary axis (W), and wherein the second section is delimited by the skirt wall, the cylinder wall, and the tube wall.

* * * * *